US008794909B2

(12) United States Patent
Lee

(10) Patent No.: US 8,794,909 B2
(45) Date of Patent: Aug. 5, 2014

(54) WATER PUMP FOR VEHICLE

(75) Inventor: Bong Sang Lee, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 947 days.

(21) Appl. No.: 12/917,256

(22) Filed: Nov. 1, 2010

(65) Prior Publication Data

US 2011/0135444 A1 Jun. 9, 2011

(30) Foreign Application Priority Data

Dec. 4, 2009 (KR) ..... 10-2009-0120068

(51) Int. Cl.
*F04D 29/049* (2006.01)
*F04D 13/02* (2006.01)
*F04D 15/00* (2006.01)

(52) U.S. Cl.
USPC ..... 415/123; 415/124.2

(58) Field of Classification Search
USPC ..... 415/18, 122.1, 123, 124.2, 229; 416/32, 416/269 R, 174
See application file for complete search history.

(56) References Cited

U.S. PATENT DOCUMENTS 6,644,933 B2 * 11/2003 Light et al. ..... 417/223
2007/0025844 A1 * 2/2007 Yamazaki et al. ..... 415/182.1
2011/0176939 A1 * 7/2011 Pasta et al. ..... 417/374

FOREIGN PATENT DOCUMENTS

JP 2008-190533 A 8/2008
KR 20040026977 A * 11/2005
WO WO 2006056494 A1 * 6/2006

* cited by examiner

*Primary Examiner* — Edward Look
*Assistant Examiner* — Jesse Prager
(74) *Attorney, Agent, or Firm* — Morgan, Lewis & Bockius LLP

(57) ABSTRACT

A water pump for a vehicle, may include a first shaft fixed to a pulley to be rotated thereby, a second shaft fixed to an impeller for pumping, and clutch that is disposed between the first shaft and the second shaft to selectively connect the first and second shafts to transfer a rotation torque of the first shaft to the second shaft.

13 Claims, 2 Drawing Sheets

WATER PUMP FOR VEHICLE

CROSS-REFERENCE TO RELATED APPLICATION

The present application claims priority to Korean Patent Application No. 10-2009-0120068 filed in the Korean Intellectual Property Office on Dec. 4, 2009, the entire contents of which is incorporated herein for all purposes by this reference.

BACKGROUND OF THE INVENTION

1. Field of the Invention

The present invention relates to a water pump applied to a vehicle. More particularly, the present invention relates to a water pump for a vehicle in which an electrical clutch is applied inside a pump body.

2. Description of Related Art

Vehicle manufacturers are currently attempting to improve fuel efficiency as well as exhaust gas quality through research processes thereof, and they have specifically increased a catalyst amount of the exhaust system or the capacity of the EGR cooler so as to satisfy emission regulations.

A coolant passage is formed between a cylinder block and a cylinder head of an engine, and a water pump circulates a coolant through the coolant passage so as to prevent overheating of the engine and sustain a regular temperature.

The water pump supplying the coolant is operated by a power transferred through a belt and circulates the coolant "radiator→cylinder→cylinder head→radiator" so as to prevent the engine from being overheated.

An impeller of the water pump is rotated by the rotation torque transferred from the engine through the belt to pump the coolant to the cylinder block, and the rotation speed of the impeller is 1.2-1.6 times that of the crankshaft.

The water pump is continuously operated by the belt after a starting of an engine to circulate the coolant regardless of a warming up condition of the engine and a coolant condition.

Accordingly, a fuel consumption and an exhaust gas are stabilized in a condition that the engine is warmed up. However, in a condition that the cold engine is started, a warming up is delayed by a circulation of the cold coolant such that a friction of an engine operating component is increased and abrasion thereof is increased.

Also, since combustion efficiency is decreased to warm up a cold engine, fuel consumption is increased, an activation time of a exhaust gas catalyst is delayed, and harmful material in the exhaust gas is increased.

However, as the water pump is always operated, there is a problem that the power of the crankshaft is lost in such a manner that the output of the engine is deteriorated and the fuel efficiency becomes lower.

Since the power is not disconnected from a crank shaft to the water pump, those problems as stated above are occurred.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a water pump for a vehicle having advantages of selectively pumping a coolant by controlling an electrical clutch according to a coolant temperature and a driving condition of an engine.

In an aspect of the present invention, the water pump for a vehicle may include a first shaft fixed to a pulley to be rotated thereby, a second shaft fixed to an impeller for pumping, and a clutch that is disposed between the first shaft and the second shaft to selectively connect the first and second shafts to transfer a rotation torque of the first shaft to the second shaft Rotation center axes of the first shaft and the second shaft may be disposed co-axially on one straight line, and the clutch is disposed between one end portion of the first shaft and one end portion of the second shaft that face with each other, wherein the clutch is operated by electricity, and includes a brake pad mounted on the one end portion of the first shaft, a clutch member slidably mounted on the one end portion of the second shaft to be movable in an axial direction thereof, an elastic member mounted on the one end portion of the second shaft and elastically biasing the clutch member toward the brake pad, and a magnet coil mounted between the clutch member and the one end portion of the second shaft.

The magnet coil may generate a magnetic force in accordance with an outside control signal and the magnet force selectively connects the clutch member to the brake pad.

The clutch member may be coupled to the brake pad by the elastic member, while the magnetic force is not generated by the magnet coil, to transfer the rotation torque of the first shaft to the second shaft.

The clutch member may be disconnected from the brake pad by the magnetic force of the magnet coil to idle the pulley.

In another aspect of the present invention, the water pump for a vehicle, may include a first shaft, one end portion of which is rotatably coupled to a pump body therein and the other end portion of which is connected to a pulley, a brake pad that is fixed to the one end portion of the first shaft in the pump body, a second shaft that is spaced apart from the first shaft, and is rotatably coupled to the pump body therein, wherein one end portion thereof is fixed to an impeller, a clutch member that is slidably coupled on the other end portion of the second shaft to be movable thereon in an axial direction corresponding to the brake pad in the pump body, an elastic member that is mounted on the other end portion of the second shaft corresponding to the clutch member, and generates an elastic force to bias the clutch member toward the brake pad, and a magnet coil that is fixed in the pump body between the clutch member and the other end portion of the second shaft to generate a magnetic force so as to move the clutch member to the brake pad.

The one end portion of the first shaft may be rotatably disposed inside one side of the pump body and supported by a first bearing therein, and the other end portion thereof is connected to the pulley through a bracket.

A flange portion may be integrally formed at the one end portion of the first shaft, and the brake pad is mounted on the flange portion in a ring shape.

The other end portion of the second shaft may be rotatably mounted inside the other side of the pump body and supported by a second bearing therein, and the one end portion thereof is fixed to the impeller, wherein a sliding portion is formed at the other end portion of the second shaft, and the clutch member is slidably coupled thereto to move along the other end portion of the sliding portion.

The clutch member may include a first portion having a cylindrical shape engaged with a spline formed in the sliding portion and a second portion having a flange shape that is integrally formed with the first portion, corresponding to the brake pad, wherein the second portion is supported by the elastic member along the other end portion of the second shaft.

The second shaft may include a large diameter portion supported by the second bearing, and a small diameter portion including the sliding portion, wherein a lateral side of the large diameter portion supports the elastic member.

A sealing unit may be interposed between the one end portion of the second shaft and the pump body so as to seal the second shaft and the pump body.

In the water pump for the vehicle according to an exemplary embodiment of the present invention as stated above, the electrical clutch is applied between the first shaft and the second shaft, the electrical clutch is operated according to the driving condition of the engine, the coolant temperature, and the driver's will to connect or disconnect the power transferred from the pulley to the impeller such that the coolant is selectively pumped.

Accordingly, a stable exhaust gas quality is secured and a cost is saved without adding a catalyst for purifying an exhaust gas in the present exemplary embodiment, and a vehicle weight is reduced by not adding an exhaust gas component to reduce fuel consumption.

Also, in a case that the coolant of the engine is in a cold state, the coolant is prevented from being circulated to quickly raise a temperature of an engine oil such that the oil friction is reduced, an abrasion of each component is minimized, and the durability thereof is improved in the present exemplary embodiment.

And, the coolant circulation is actively controlled in an early stage of the engine in the present exemplary embodiment to offer a short activation time of the engine, to reduce fuel consumption through a stable combustion, and to stabilize the exhaust gas quality by reducing a catalyst activation period.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
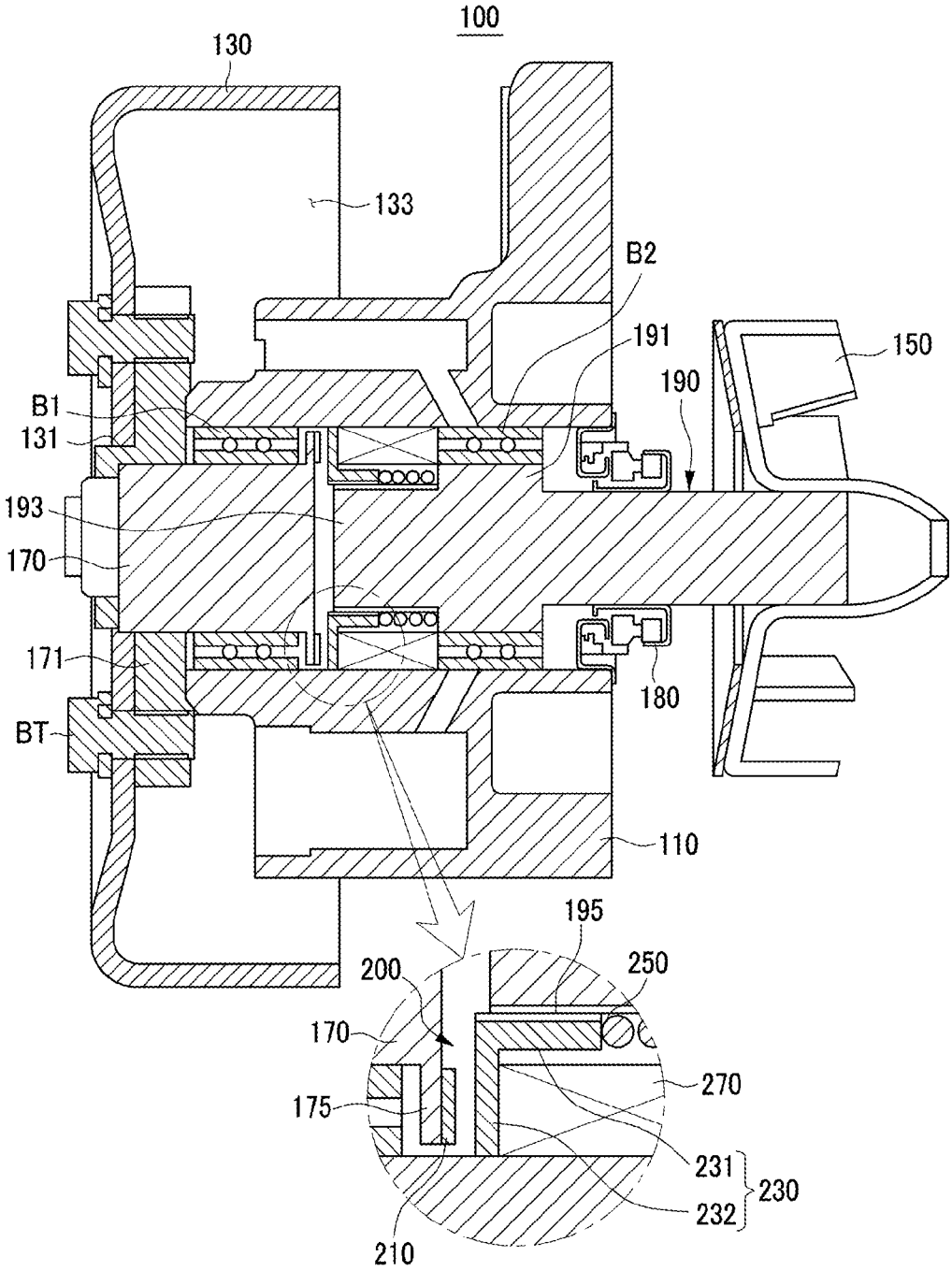
FIG. 1 is a cross sectional view showing an operation state of a water pump of a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
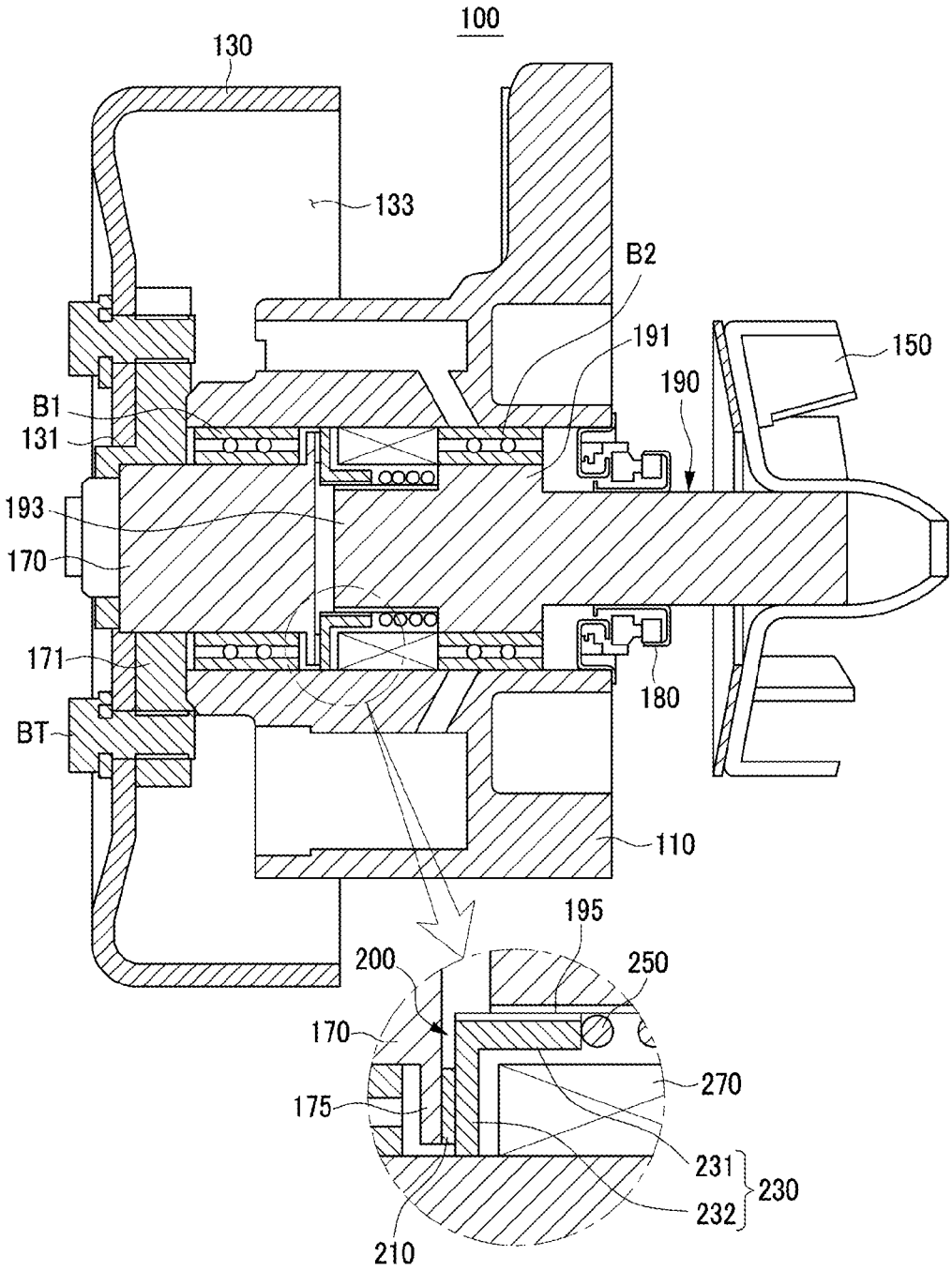
FIG. 2 is a cross-sectional view showing a shut down state of a water pump according to an exemplary embodiment of the present invention.

FIG. 1 is a cross sectional view showing an operation state of a water pump of a vehicle according to an exemplary embodiment of the present invention, and FIG. 2 is a cross-sectional view showing a shut down state of a water pump according to an exemplary embodiment of the present invention.

Referring to the drawings, a water pump 100 for a vehicle according to an exemplary embodiment of the present invention uses a power transferred from an engine through a belt to circulate a coolant such that a temperature of an engine is stably sustained.

The water pump 100 for a vehicle includes a pump body 110, a pulley 130 that is rotatably disposed in the pump body 110 to receive a power from the engine, and an impeller that is rotatably disposed in the pump body to pump the coolant.

Accordingly, the belt transfers a power from the crank shaft to the pulley through the operation of the engine such that the pulley 130 rotates according to a rotation speed of the crank shaft, and the impeller 150 rotates to pump the coolant.

Therefore, the coolant circulates a coolant passage formed in a cylinder by the rotation of the impeller 150 so as to steadily sustain the temperature of the engine.

In the present exemplary embodiment, the water pump 100 for the vehicle uses an electrical clutch 200 in the pump body 110, and the clutch 200 is controlled according to a driving condition and a coolant temperature of the engine, and a driver's will so as to selectively pump the coolant.

For this, the water pump 100 for the vehicle according to an exemplary embodiment of the present invention includes the pump body 110, the pulley 130, and the impeller 150, a first shaft and a second shaft are disposed in an axial direction in the pump body 110, the electrical clutch 200 is between the first and the second shafts, and they are explained as follows.

More specifically, the water pump 100 for the vehicle in the present exemplary embodiment has a structure in which the first and the second shafts 170 and 190 are clutch type inside the pump body 110.

In the present exemplary embodiment, the electrical clutch 200 includes a brake pad 210, a clutch member 230, a return spring 250, and a magnetic coil 270.

In the above, the pump body 110 has a coolant inlet through which the coolant flows in, the pulley 130 is disposed at one side of the pump body 110, and the impeller 150 is disposed at the other side of the pump body 110.

In this case, the pulley 130 receives a poser from a crank shaft of an engine, a penetration hole 131 is formed in a middle portion thereof, and a pulley room 133 is formed along a circumference of the penetration hole 131.

In the present exemplary embodiment, the first shaft 170 is rotatably disposed at one side of the pump body 110 to be connected to the pulley 130 as stated above.

The first shaft 170 is rotatably disposed inside the pump body 110 through a first bearing B1, and one side end portion thereof is connected to the pulley 130 through a bracket 171.

In other words, one side end portion of the first shaft 170 protrudes in one side of the pump body 110 to be inserted into the bracket 171. And, the other end portion of the first shaft 170 is disposed inside the pump body 110 to be supported by the first bearing B1 inside the pump body 110.

In this case, the bracket 171 is fixed to one side end portion of the first shaft 170 to be engaged with the penetration hole 131 of the pulley 130, and the bracket is fixed to the pulley by a bolt (BT).

And, a flange portion 175 is formed along a circumference of the first shaft 179 in the other end portion. In this case, a brake pad 210 is bonded on a surface of the flange portion 175.

In the present exemplary embodiment, the second shaft is rotatably disposed at the other side of the pump body 110 to be connected to the impeller as stated above.

The second shaft 190 is rotatably disposed at the other side of the pump body 110 through the second bearing B2, and the other side portion thereof is connected to the impeller 150.

One end portion of the second shaft 190 is spaced apart from the other end portion of the first shaft 170 in the pump body 110, and the other end portion thereof protrudes out of the pump body 110

In the other end portion, a sealing unit 180 is interposed between the pump body 110 and the second shaft 190, and the impeller 150 is engaged at the other end portion of the second shaft 190. And one end portion of the second shaft 190 is spaced apart from the other end portion of the first shaft 170 in the pump body 110.

In this case, a large diameter portion 191 and a small diameter portion that is smaller than that of the large diameter portion 191 are formed at the second shaft 190 inside the pump body 110.

In this case, a sliding portion 195 is formed on the small diameter portion 193, and the clutch member 230 slides along the sliding portion 195.

In the present exemplary embodiment, the brake pad 210 contacts the clutch member 230 to generate friction force, is made up of a metal material having a ring shape, and the brake pad 210 is fixed on a surface of the flange portion 175.

In the present exemplary embodiment, the clutch member 230 is mounted on the second shaft 190 corresponding to the brake pad 210 of the pump body 110 to be slidable in an axial direction thereof.

The clutch member 230 is engaged with the sliding portion 195 through a spline formed on the small diameter portion 193 of the one end portion of the second shaft 190 to be movable in an axial direction thereof.

The clutch member 230 is made up of a metal material, and includes a first portion 231 having a cylinder shape engaged with a spline of the sliding portion 195 and a second portion 232 integrally formed with the first portion 231 having a flange shape corresponding to the brake pad 210.

In this case, the second portion 232 is integrally formed with end portion of the first portion 231, and has a ring shape to be able to be contacted the brake pad 210.

In the present exemplary embodiment, the return spring 250 is mounted on the second shaft 190 corresponding to the clutch member 230 to generate an elastic force to the clutch member 230.

The return spring 250 has a compressed coil spring type to be mounted on the small diameter portion 193 of the second shaft 190 corresponding to the clutch member 230. In other words, one end of the return spring 250 is supported by the first portion 231 of the clutch member 230, and the other end thereof is supported by the large diameter portion 191.

In the present exemplary embodiment, the magnet coil 270 receives a control signal from an outside to generate a magnetic force, and is fixed inside the pump body 110 corresponding to the first portion of the clutch member 230.

The magnet coil 270 is built in a coil case that is magnetized by a magnetic force.

Accordingly, in the water pump 100 for a vehicle according to an exemplary embodiment of the present invention, firstly, in a condition that an electricity power is not supplied to the magnet coil 270, as shown in a FIG. 2, the clutch member 230 of the second shaft 190 closely contacts the brake pad 210 of the first shaft 170 by the elastic force of the return spring 250.

Thereby, if the power of the engine is transferred to the pulley 130 through the belt, the clutch member 230 is connected to the brake pad 210 by a friction force between them such that the engine power is transferred from the first shaft 170 to the second shaft 190, the pulley 130, the first shaft 170, and the second shaft 190 rotates together to rotate the impeller 150 such that the coolant is pumped.

If a rotation speed of an engine exceeds a predetermined value, or if the coolant temperature exceeds a predetermined value, the coolant is pumped.

Also, the coolant is pumped regardless of the engine speed and the coolant temperature so as to heat an interior room of a vehicle, in a case that a heater switch is turned on.

However, if the above conditions are not satisfied, in other words, if the engine is operated in a low RPM, the coolant temperature is less than a predetermined value, or the heater switch is turned off, the magnet coil 270 receives an electrical power according to outside control signal to generate a magnetic force.

Accordingly, the magnetic coil 270 draws the clutch member 230 with a predetermined magnetic force, as shown in a FIG. 1. In that case, the clutch member 230 overcomes an elastic force of the return spring 250 to move to the magnetic coil 270 in an axial direction of the second shaft 190 such that the clutch member 230 is separated from the brake pad 210.

Hereby, the clutch member 230 and the brake pad 210 are separated to disconnect the first shaft 170 and the second shaft 190*a*, and a rotation power of the first shaft is not transferred to the second shaft such that the impeller 150 does not pump the coolant in the present exemplary embodiment.

As stated above, the water pump 100 for the vehicle according to an exemplary embodiment of the present invention operates the electric clutch 200 by the outside control signal according to the driving condition and the coolant temperature to disconnect or connect the rotation power of the pulley 130 such that the coolant is selectively pumped.

Hereby, a stable exhaust gas quality is secured and a cost is saved without adding a catalyst for purifying an exhaust gas in the present exemplary embodiment, and a vehicle weight is reduced by not adding an exhaust gas component to reduce fuel consumption.

Also, in a case that the coolant of the engine is in a cold state, the coolant is prevented from being circulated to quickly raise a temperature of an engine oil such that the oil friction is reduced, an abrasion of each component is minimized, and the durability thereof is improved in the present exemplary embodiment.

And, the coolant circulation is actively controlled in an early stage of the engine in the present exemplary embodiment to offer a short activation time of the engine, to reduce fuel consumption through a stable combustion, and to stabilize the exhaust gas quality by reducing a catalyst activation period.

For convenience in explanation and accurate definition in the appended claims, the terms "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A water pump for a vehicle, comprising:

a first shaft fixed to a pulley to be rotated thereby;

a second shaft fixed to an impeller for pumping at one end portion; and a clutch that is disposed between the first shaft and the second shaft to selectively connect the first and second shafts to transfer a rotation torque of the first shaft to the second shaft;

wherein a sliding portion is formed at the other end portion of the second shaft, and the clutch member is slidably coupled thereto to move along the other end portion of the sliding portion; and wherein the clutch member includes a first portion having a cylindrical shape slidably engaged with a spline formed in the sliding portion and a second portion having a flange shape that is integrally formed with the first portion, corresponding to the brake pad.

2. The water pump for the vehicle of claim 1, wherein rotation center axes of the first shaft and the second shaft are disposed co-axially on one straight line, and the clutch is disposed between one end portion of the first shaft and the other end portion of the second shaft that face with each other.

3. The water pump for the vehicle of claim 2, wherein the clutch is operated by electricity, and includes a brake pad mounted on the one end portion of the first shaft;

an elastic member mounted on the other end portion of the second shaft and elastically biasing the clutch member toward the brake pad; and a magnet coil mounted between the clutch member and the other end portion of the second shaft.

4. The water pump for the vehicle of claim 3, wherein the magnet coil generates a magnetic force in accordance with an outside control signal and the magnet force selectively connects the clutch member to the brake pad.

5. The water pump for the vehicle of claim 3, wherein the clutch member is coupled to the brake pad by the elastic member, while the magnetic force is not generated by the magnet coil, to transfer the rotation torque of the first shaft to the second shaft.

6. The water pump for the vehicle of claim 3, wherein the clutch member is disconnected from the brake pad by the magnetic force of the magnet coil to idle the pulley.

7. A water pump for a vehicle, comprising:

a first shaft, one end portion of which is rotatably coupled to a pump body therein and the other end portion of which is connected to a pulley;

a brake pad that is fixed to the one end portion of the first shaft in the pump body;

a second shaft that is spaced apart from the first shaft, and is rotatably coupled to the pump body therein, wherein one end portion thereof is fixed to an impeller;

a clutch member that is slidably coupled on the other end portion of the second shaft to be movable thereon in an axial direction corresponding to the brake pad in the pump body;

an elastic member that is mounted on the other end portion of the second shaft corresponding to the clutch member, and generates an elastic force to bias the clutch member toward the brake pad; and a magnet coil that is fixed in the pump body between the clutch member and the other end portion of the second shaft to generate a magnetic force so as to move the clutch member to the brake pad;

wherein a sliding portion is formed at the other end portion of the second shaft, and the clutch member is slidably coupled thereto to move along the other end portion of the sliding portion; and wherein the clutch member includes:

a first portion having a cylindrical shape slidably engaged with a spline formed in the sliding portion and elastically biased by the elastic member; and a second portion having a flange shape that is integrally formed with the first portion, corresponding to the brake pad.

8. The water pump for the vehicle of claim 7, wherein the one end portion of the first shaft is rotatably disposed inside one side of the pump body and supported by a first bearing therein, and the other end portion thereof is connected to the pulley through a bracket.

9. The water pump for the vehicle of claim 7, wherein a flange portion is integrally formed at the one end portion of the first shaft, and the brake pad is mounted on the flange portion in a ring shape.

10. The water pump for the vehicle of claim 7, wherein the other end portion of the second shaft is rotatably mounted inside the other side of the pump body and supported by a second bearing therein, and the one end portion thereof is fixed to the impeller.

11. The water pump for the vehicle of claim 7, wherein the second shaft includes a large diameter portion supported by the second bearing, and a small diameter portion including the sliding portion.

12. The water pump for the vehicle of claim 11, wherein a lateral side of the large diameter portion supports the elastic member.

13. The water pump for the vehicle of claim 7, wherein a sealing unit is interposed between the one end portion of the second shaft and the pump body so as to seal the second shaft and the pump body.

* * * * *